US006032854A

United States Patent [19]

Greer et al.

[11] Patent Number: 6,032,854

[45] Date of Patent: Mar. 7, 2000

[54] MULTIPLE-USE SEALABLE PACKAGES

[75] Inventors: Jeffrey P. Greer, Wilmington, Del.; Quentin W. Howard, Jr., Exton, Pa.

[73] Assignee: International Envelope Company, Exton, Pa.

[21] Appl. No.: 09/035,007

[22] Filed: Mar. 5, 1998

[51] Int. Cl.[7] ..... B65D 27/06

[52] U.S. Cl. ..... 229/301; 229/80; 229/313

[58] Field of Search ..... 229/80, 70, 301, 229/302, 305, 306, 313; 383/62, 84, 85, 86

[56] References Cited

U.S. PATENT DOCUMENTS

| | | | |
|---|---|---|---|
| 192,522 | 6/1877 | Marshall . | |
| 1,091,172 | 3/1914 | Thayer . | |
| 1,553,028 | 9/1925 | Bumgardner . | |
| 3,946,938 | 3/1976 | Kranz . | |
| 4,807,805 | 2/1989 | Rutkowski | 229/80 X |
| 5,025,980 | 6/1991 | Blackman . | |
| 5,044,776 | 9/1991 | Schramer et al. | 383/89 |
| 5,213,258 | 5/1993 | Kim . | |
| 5,400,957 | 3/1995 | Stude . | |
| 5,415,341 | 5/1995 | Diamond . | |
| 5,499,757 | 3/1996 | Back . | |
| 5,503,328 | 4/1996 | Roccaforte et al. . | |

FOREIGN PATENT DOCUMENTS

| | | | |
|---|---|---|---|
| 642123 | 9/1993 | Austria | 229/301 |
| 2647357 | 4/1977 | Germany | 229/80 |
| 680124 | 6/1992 | Switzerland | 229/301 |
| 9319991 | 10/1993 | WIPO | 229/300 |

*Primary Examiner*—Jes F. Pascua
*Attorney, Agent, or Firm*—Akin, Gump, Strauss, Hauer & Feld, L.L.P.

[57] ABSTRACT

A multiple-use, sealable flat envelope has a body of spunbonded olefin sheet. The body has one side edge with a mouth opening and a spunbonded olefin sheet closure flap extends continuously in one piece from the body on one side of the mouth opening. The flap has an inner surface facing and overlapping an edge portion of the body adjoining the mouth opening when the closure flap is folded back toward the body and fully extended over the mouth opening and against the body to close the mouth opening. Two adjoining but separate and spaced apart hot melt, pressure sensitive adhesive closures are provided on the spunbonded olefin sheet of the envelope proximal the mouth opening. One adhesive closure is located farther from the mouth opening than is the remaining adhesive closure. A line of openings through the closure flap extends entirely across the closure flap, the openings being spaced sufficiently closely to one another along the line that a tear force required to break bridges of the spunbonded olefin sheet of the closure flap between adjoining pairs of the openings of the line is less than a tear force required to separate either adhesive closure from the spunbonded olefin sheet supporting the adhesive closure. Where one release liner overlies each of the two adhesive closures, it is divided by a line of weakness extending across the release liner. The release liner line of weakness is positioned to lie between the two adhesive closures and to be closer to the mouth opening than is the line of openings through the closure flap with the closure flap fully extended over the edge portion of the body. Where separate adhesive closures are provided on the body and the flap, separate release liners are provided. The outer edge of the innermost liner is located closer to the mouth opening than is the line of openings through the flap. A line of openings can be provided through the body proximal to the mouth opening to define a breakaway region overlapped by the innermost located adhesive closure.

10 Claims, 3 Drawing Sheets

MULTIPLE-USE SEALABLE PACKAGES

BACKGROUND OF THE INVENTION

Spunbonded olefin sheet material is very desirable packaging material for numerous uses, including envelopes, (flat or expansion) pouches, folders, sleeves, etc. Spunbonded olefin sheet material is relatively light for its strength in comparison to paper and other, conventional packaging materials. One reason it is good for packaging is its strength. Typically, paper weighing two to three times as much as spunbonded olefin sheet is required to provide comparable strength.

Spunbonded olefin sheet has other characteristics making it desirable for packaging. The dense fiber network forming the sheet material offers extremely high resistance to tear, puncture and abrasion. Spunbonded olefin sheet material has excellent resistance to waterborne soil and good resistance to degradation from age unless overly exposed to ultraviolet light. It is inert to most acids, unaffected by water or highly polar solvents and is therefore readily washable. It further meets the requirements of the Federal Flame Fabrics Act. Spunbonded olefin sheet is sold in different forms which have different characteristics in terms of tear strengths, tensile strengths, smoothness, porosity, flexibility and softness.

Either cold applied adhesives such as polyvinyl acetate resin (PVA) or hot-melt pressure sensitive adhesive (PSA) are typically used with spunbonded olefin material in packaging. Such adhesives are very tenacious and stick firmly to the generally smooth and non-porous olefin sheet. Hot-melt adhesive can be applied during package fabrication to the closure flap as a pressure-sensitive adhesive closure with a release material liner protecting the closure until it is time to seal the mouth of the package.

Because hot-melt adhesives are so tenacious, considerable force is necessary to separate the flap from the body of the package on which such adhesives are used. Typically, the opening of an olefin sheet package closed with hot-melt adhesive results in a partial tearing away of filaments from the remaining surface of the olefin sheet and an extension from the surface of the olefin sheet of those partially torn away filaments. Also, there is typically significant stretching and wrinkling of the olefin material forming at least the flap portion and the portion of the package body receiving the flap portion in the region of the adhesive when such a package is opened. This causes a noticeable distortion of the package. Because the flap and body of an olefin sheet package are both typically damaged when the package is first opened, spunbonded olefin has not been used in multiple-use, sealed packaging.

It would be very desirable to incorporate spunbonded olefin sheet material into resealable, multiple-use package (s).

BRIEF SUMMARY OF THE INVENTION

In one aspect, the invention is a multiple-use, sealable package comprising a body of spunbonded olefin sheet, the body having at least one side edge with a mouth opening; a closure flap of spunbonded olefin sheet extending from the body at the side edge along the mouth opening, the closure flap having an inner surface facing and overlapping an edge portion of the body adjoining the mouth opening with the closure flap folded and fully extended over the mouth opening and against the body to close the mouth opening; two separate and spaced apart adhesive closures, each adhesive closure being located on the spunbonded olefin sheet proximal the mouth opening, one adhesive closure being located farther from the mouth opening than is a remaining adhesive closure; a line of openings extending through and across the closure flap, the openings being spaced sufficiently closely to one another along the line that a tear force required to break bridges of the spunbonded olefin sheet of the closure flap between adjoining pairs of the openings of the line is less than a tear force required to separate one of the adhesive closures from the spunbonded olefin sheet supporting the one adhesive closure, the line of openings being located on the closure flap to extend between the two adhesive closures with the closure flap positioned to fully overlap the edge portion of the package body; and release liner means positioned to overlie each of the two adhesive closures for protecting the adhesive closures before use, the release liner means being in two parts, one of the two parts overlying the remaining adhesive closure and having an outermost edge located closer to the mouth opening than is the line of openings extending through and across the closure flap.

In a preferred embodiment, the invention is a multiple-use, sealable flat envelope comprising a body of spunbonded olefin sheet having two flat, juxtaposed panels, one side edge with a mouth opening and three remaining, permanently closed side edges; a spunbonded olefin sheet closure flap extending continuously in one piece from one of the panels of the body along at the one side edge of the body, the closure flap having an inner surface facing and overlapping an edge portion of a remaining panel of the body adjoining the mouth opening when the closure flap is folded back towards the body and fully extended over the mouth opening against the remaining panel of the body to close the mouth opening; two adjoining but separate and spaced apart hot melt, pressure sensitive adhesive closures on the spunbonded olefin sheet of the inner surface of the closure flap; a line of openings through the closure flap extending entirely across the closure flap, the openings being spaced sufficiently closely to one another along the line that a tear force required to break bridges of the spunbonded olefin sheet of the closure flap between adjoining pairs of the openings of the line is less than a tear force required to separate either adhesive closure from the spunbonded olefin sheet of the closure flap supporting the adhesive closures and; a release liner on the inner surface of the closure flap positioned overlying each of the two adhesive closures, the release liner being divided by a line of weakness extending across the release liner, the release liner line of weakness being located on the closure flap to lie between the two adhesive closures and to be closer to the mouth opening than is the line of openings through the closure flap.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
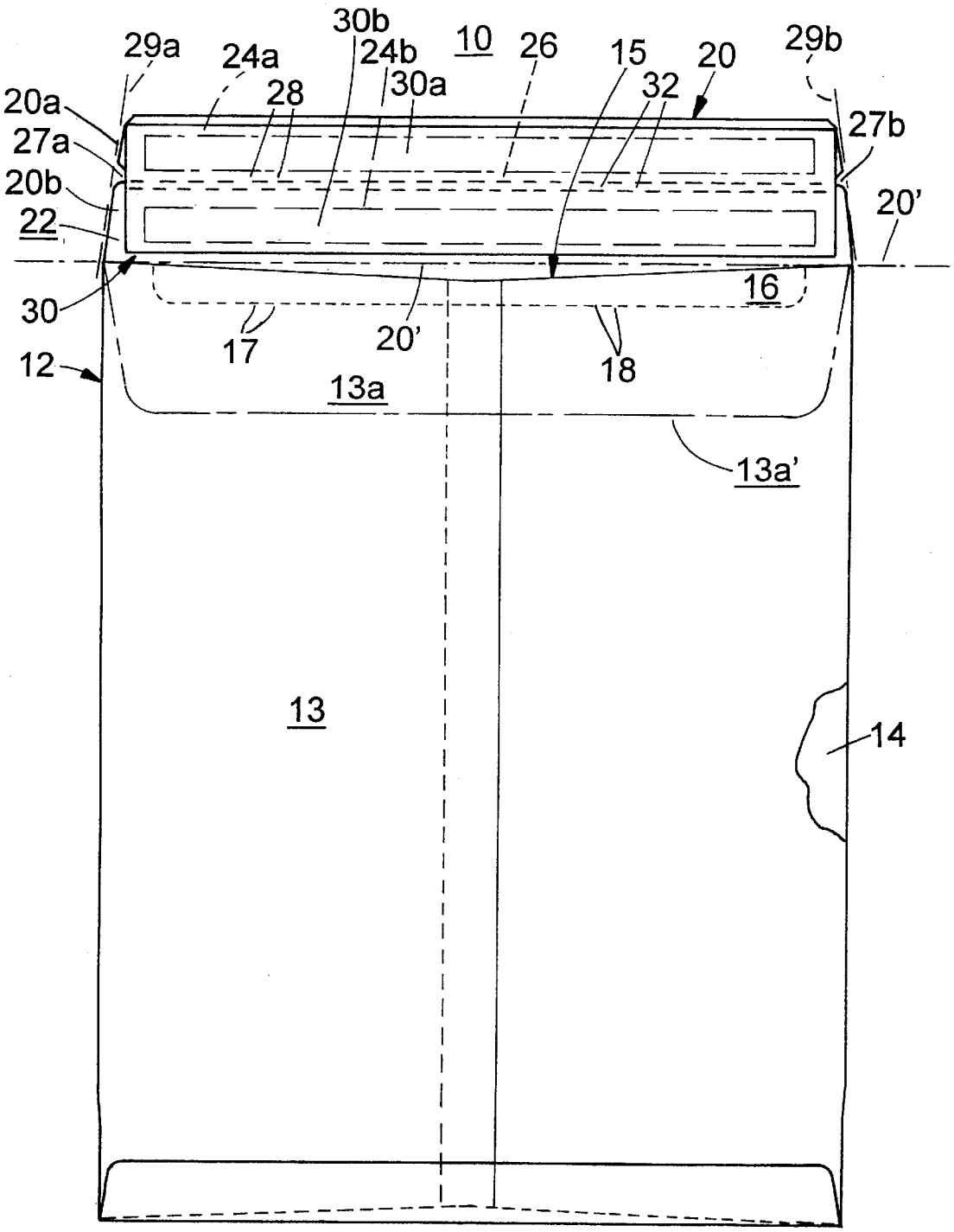
FIG. 1 is a plan view of one side of a multiple use, resealable package of the present invention in the form of an envelope in an open configuration.

In the drawings, like numerals are used to indicate like elements throughout. Certain terminology is used for convenience only in this and is not limiting. The words "right," "left," "lower" and "upper" designate directions in the drawings to which reference is made. The words "inwardly" and "outwardly" refer to directions towards and away from, respectively, the geometric center of the package or designated parts of the package.

Figure 2:
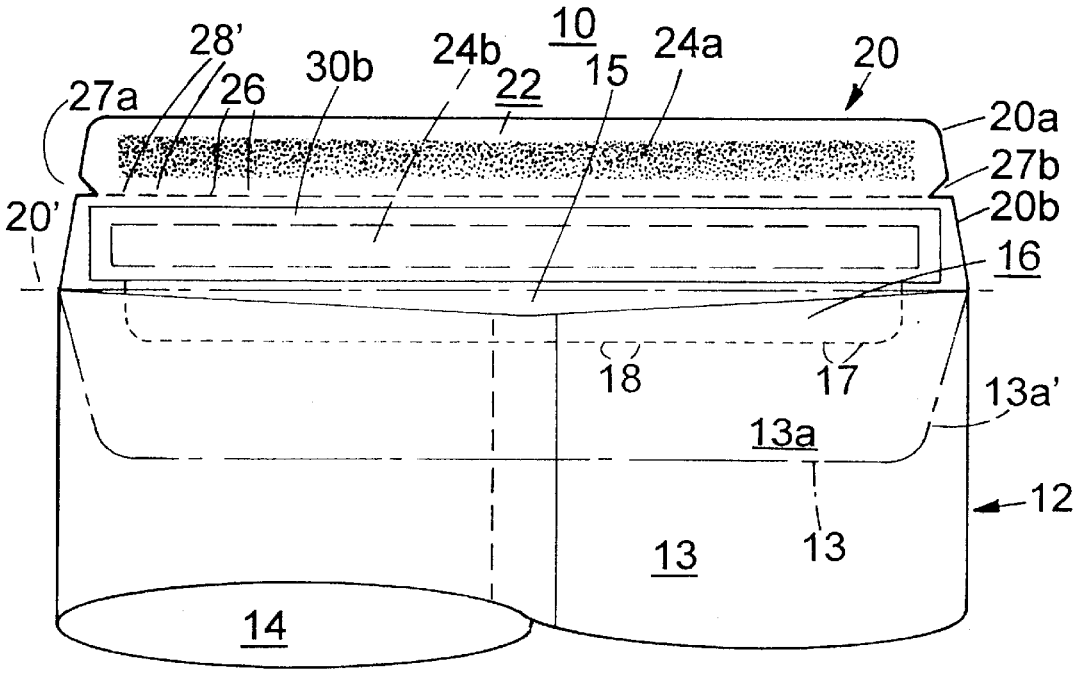
FIG. 2 is a cut-away plan view of the mouth opening end of the package of FIG. 1 after removal of half of the release liner and before sealing of the package.
Figure 3:
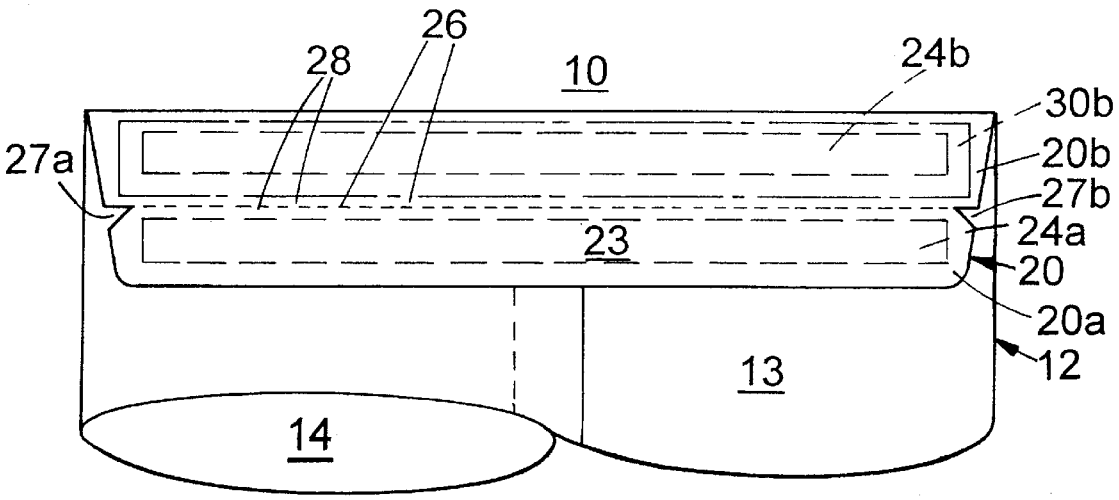
FIG. 3 is a cut-away plan view of the mouth opening end of the package of FIGS. 1 and 2 after first closure and sealing of the package.
Figure 6:
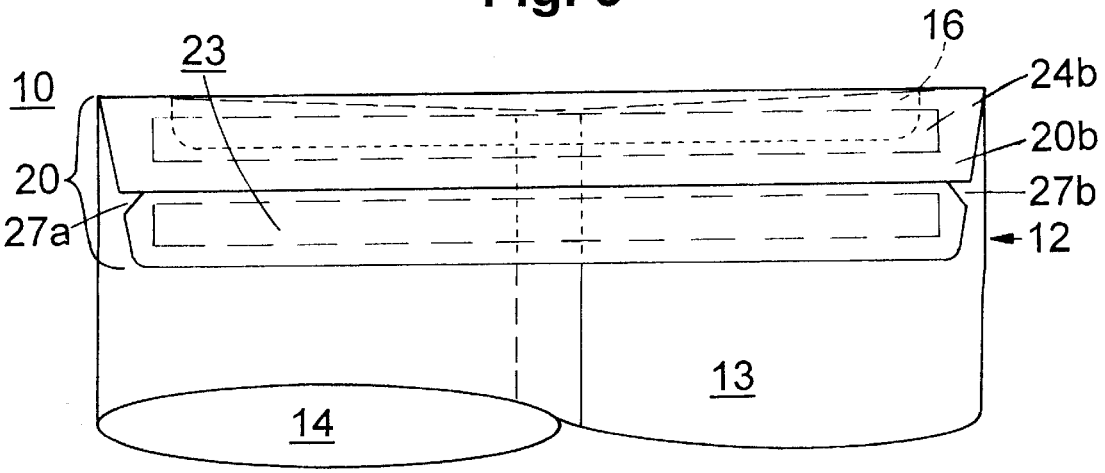
FIG. 6 is a cut-away plan view of the mouth opening end of the package of FIGS. 1–5 after the second closure of the flap.

There is shown in the various figures a multiple-use, sealable package according to the present invention in one form, namely an envelope or "flat mailer" indicated generally at 10. Preferably, the envelope 10 is formed from one continuous piece of spunbonded olefin sheet, which is folded and bonded together in a conventional fashion to form a normally flat body indicated generally at 12. The normally flat body 12 has a pair of adjoining and opposing major sides defined by panels 13 and 14. At least one side edge of the body 12 has a mouth opening 15. Preferably, each of the remaining three side edges of the body 12 are permanently closed. A closure flap 20 of spunbonded olefin sheet extends from the body 12 at the side edge along the mouth opening 15. While one of the shorter edges of envelope 10 has been provided with mount opening 15 and closure flap 20, both could have been provided on a longer side edge of the envelope. The closure flap 20 has an inner surface 22 seen in FIGS. 1, 2, 4 and 5 and an opposing outer surface 23 seen in FIGS. 3 and 6. The inner surface 22 faces and overlaps an edge portion 13*a* of panel 13 of the body 12 proximal the mouth opening 15 when the closure flap 20 is folded back toward the body and fully extended over the mouth opening 15 and against panel 13 of the body 12 to close the mouth opening 15 as indicated in FIG. 3. In the preferred embodiment, the closure flap 20 is merely a continuous extension of the panel 14 of the body 12 beyond the adjoining edge of panel 13 at the mouth opening 15 and beyond a fold line 20', which is tangent to the side edges of panel 13 where it joins panel 14 at the mouth opening edge of the envelope body 12. The edge portion 13*a* is bounded on one side by the mouth opening 15 and is identified by broken line 13*a'*.

According to an important aspect of the invention, two adjoining but separate and spaced apart adhesive closure 24*a*, 24*b* are provided, on the spunbonded olefin sheet near (proximal) the mouth opening 15. Preferably both are located on the inner surface 22 of the closure flap 20 as shown in FIGS. 1 and 2. Alternatively, the two adhesive closures could have been located in the edge portion 13*a* of the body 12 overlapped by the closure flap 20 or one located in the edge portion and one located on the closure flap. (Neither of the latter two engagements is depicted.) In any of the three possible arrangements, one closure 24*a* is located farther or more remotely ("distally") from mouth opening 15 and fold line 20' in either the open position of closure flap 20 (seen in FIGS. 1, 2, 4 and 5) or the closed position of flap 20 (seen in FIGS. 3 and 6) than is the second, remaining, "proximal" closure 24*b*.

Also according to an important aspect of the invention, a line of openings 26 through closure flap 20 extends across the closure flap 20, preferably from one side edge to an opposing side edge of the closure flap 20. The openings 26 divide the flap 20 into a first or distal portion 20*a* and a remaining or proximal portion 20*b*. The openings 26 are spaced sufficiently closely to one another along the line that the tear force required to break bridges 28 of the spunbonded olefin sheet of the closure flap 20 between adjoining pairs of the openings 26 of the line is less than a tear force required to separate the one of the adhesive closures 24*a*, 24*b* from the closure flap 20 (or the edge portion 13*a* of the body 12 once the envelope 10 is sealed with adhesive closure 24*a*). The spaced apart adhesive closures 24*a* and 24*b* are located on the closure flap 20 on opposite sides of the line of openings 26 extending across that flap. If the adhesive closures were to have been applied to the edge portion 13*a* of the body 12, they would also be spaced apart and located so as to be on either side of the line of openings 26 when the closure flap 20 with the closure flap folded back over line 20' and fully extended over the mouth opening 15, fully overlapping the edge portion 13*a* and closing the mouth opening 15 as indicated in FIG. 3. Openings 26 are preferably slits cut through the spunbonded olefin sheet forming flap 20.

A separate release liner 30 is provided on the inner surface 22 of closure flap 20 simultaneously covering the two adhesive closures 24*a*, 24*b* for protecting the adhesive closures before use. The release liner 30 is also divided into two parts 30*a*, 30*b* by at least one line of weakness 32, which extends across the release liner 30. Preferably the line of weakness 32 is provided by the line of perforations through the release liner 30, but may also be provided in other conventional forms, depending upon the composition of the release liner (e.g., paper, plastic, foil, composite, etc.). The at least one line of weakness 32 extending across the release liner 30 is located on the package 10 to lie between the two adhesive closures 24*a*, 24*b* and to be closer to the open mouth 15 of the package 10 than is the line of openings 26 through the closure flap 20. If the adhesive closure 24*a*, 24*b* and release liner 30 were located on panel 13 of the body 12, then the line of weakness 32 would still be positioned on the package 10 so as to be located closer to the mouth opening 15 than is the line of openings 26 through the closure flap 20.

Closure flap 20 is further suggestedly provided with at least one and preferably two notches 27*a*, 27*b*, each of which extends into one of the opposing edges of the closure flap 20 at opposing ends of the line of openings 26 through the closure flap. Each notch 27*a*, 27*b* defines an opening along the edge of the closure flap larger in area than the areas of any of the openings 26 adjoining either notch 27*a*, 27*b*. The area of the notch 27*a* or 27*b* is the open area within tangent line 29*a* or 29*b* to the side edge of the closure flap on either side of the line of openings 26.

If desired, the part of panel 13 of the body 12 overlaid by the proximal end 20*b* of the closure flap 20 and the proximate adhesive closure 24*b* can be provided with a breakaway region indicated generally at 16 and preferably defined by a continuous line of openings 17 through the body 12 proximal to the mouth opening 15. The breakaway region 16 is located such that at least part of the proximal or "remaining" adhesive closure 24*b* overlaps at least part of the breakaway region 16 when the closure flap 20 is folded back along fold line 20' and fully extended over the edge portion 13*a* of the body 12 to close the mouth opening 15. The breakaway region 16, overlapped by the proximal adhesive closure 24*b*, is subject to tear forces applied to the package 10 to separate the remainder 20*b* of the closure flap 20 from the adjoining panel 13 when the package is opened after the closure flap 20 is sealed for the second time with the proximal adhesive closure 24*b*. The continuous line of openings 17 defines all but a final side (typically at least three sides) of the breakaway region 16 with the final side (typically a fourth side) defined by the edge of panel 13 at mouth opening 15. The openings 17 in the body 12 are also spaced just sufficiently closely to one another along the line that a tear force required to break bridges 18 of the spunbonded olefin sheet forming the panel 13, which are left between adjoining pairs of the openings 17 of the line, is less than the tear force required to separate either the remainder 20*b* of the closure flap 20 or the breakaway region 16 from the remaining adhesive closure 24*b*. Further detail about the provision of such breakaway regions can be found in U.S. Pat. No. 5,499,757, incorporated by reference herein in its entirety. The openings of line 17 are also preferably perforations formed by cut slits through the spunbonded olefin sheet.

While the presently preferred embodiment of the invention is a flat envelope, the invention is suitable for use in other types of spunbonded olefin sheet packaging. Furthermore, while it is preferred that both adhesive closures and the single release liner be applied to the envelope closure flap, the two adhesive closures and the single release liner could, less desirably, be applied to the body of the envelope or other package and, least desirably, could be split between the body and the closure flap. That is, one adhesive closure with a release liner would be located on the body and one with separate release liner located on the flap. The far or outer or "distal" edge of the release liner overlying the adhesive closure 24*b* located closest to the mouth opening 15 of the package would also be located closer to the mouth opening 15 than would the line of perforation through the closure flap. While hot-melt, pressure sensitive adhesives are preferred for the flap, other adhesives such as cold applied PVA resin might be used as might still other bonding agents on the flaps and/or on seams of the envelope.

The fabrication of envelope 10 is conventional quite similar to the fabrication of single use, sealable, spunbonded olefin sheet envelopes with the additional provision of the line of openings 26 and notches 27*a* and 27*b* in the closure flap 20, two adhesive closures 24*a*, 24*b* instead of one and a line of weakness 32 in release liner 30. The particular spunbonded olefin material selected should depend upon the intended use of the package. As an example, a conventional, flat envelope like envelope 10 described above, might use a Type 1056/D or 1070/D or other grade weight of Tyvek® material, manufactured by E. I. Dupont & Company of Wilmington, Del. The hot-melt, pressure sensitive adhesive, which could be used on both the permanently sealed seams and the closure flap, might be, for example, adhesive no. HL 2605X of the H. B. Fuller Co. of Baltimore, Md. The release liner, might be, for example, stock 25 to 30 ksia of Tekkote of Leonia, N.J., which are 25 to 30 lb. weight paper bases having a silicone treatment on only one side. For the indicated Tyvek® material weights, the openings 26 through the flap might be cut slits spaced ⅛ inch apart and ranging from 1/64 to 1/16 inch in length.

Envelope 10 preferably is formed from a continuous, one piece blank of spunbonded olefin sheet. Panel 14 (which supports closure flap 20) is seamless and unbroken while the remaining panel 13 is formed by folding over two side flaps (on either side of the closure flap) and a bottom flap (opposite the closure flap) in a conventional fashion, again preferably utilizing a hot-melt adhesive to permanently seal the mutually overlying flaps.

Preferably, the hot-melt, pressure sensitive adhesive is extruded in two separate and spaced apart lines on the silicone treated side of a continuous length of the release liner web with gaps along the extended lines. The gaps are positioned or located to define the areas along the continuous length where it is cut to form an individual release liner to be applied as noted above to a single envelope. Preferably, each adhesive closure 24*a*, 24*b* is indented somewhat from the side edges of the closure flap 20, (those edges between which the line of openings 26 extends), so as to provide a free side edge portion of the closure flap 20 which can be gripped to tear the closure flap along the line of openings 26 to open the envelope 10 after it has been sealed a first time. The continuous length web of release material is cut to an individual envelope length and applied to the flap 20 with the adhesive facing the flap inner surface 22.

Preferably, the outer (distal) part 30*a* of the release liner 30 extends even with or somewhat recessed from the outermost edge of the closure flap 20 to prevent the release liner 30 from being accidentally grabbed and/or disrupted before the envelope is sealed. Alteratively, the outer (distal) edge of release liner 30 can extend beyond the outer edge of closure flap 20 to enable the distal half 30*a* of the release liner to be easily gripped to separate that part 30*a* from the remaining part 30*b* of the release liner 30, which is located more proximal to the mouth opening 15.

Envelope 10 preferably is used in the manner indicated in FIGS. 1 through 6. As shown in FIG. 1, the closure flap 20 is initially unfolded or folded away from the body 12 of the envelope 10 to expose the mouth opening 15 for insertion of contents into the envelope 10. As shown in FIG. 2, a distal part 30*a* of the release liner 30 is removed to expose the first or distal adhesive closure 24*a* and, leaving only the proximal part 30*b* over the remaining, more proximally located adhesive closure 24*b*. The closure flap 20 is then folded back towards the body 12 generally along the fold line 20', which is tangent to the two edges of the envelope 10 at either lateral side of the closure flap 20, and is fully extended over the mouth opening 15 and pressed against the body 12 as shown in FIG. 3 to close mouth opening 15. The once closed envelope 10 shown in FIG. 3 is opened by pulling the remaining or proximal portion 20*b* of the closure flap from the first portion 20*a*, which is adhered to envelope body 10, until the closure flap 20 parts along line of openings 26 or cutting the flap 20 preferably through or along the line of openings 26. The proximal part 30*b* of the release liner 30 is shown in phantom in FIG. 3. The lateral edges of the release liner 30 preferably are recessed away from the lateral edges of the closure flap 20 while the outer or remote or distal edge of that remaining part 30*b* of the release liner 30 is recessed from the line of openings 26 through the closure flap 20 so that when the closure flap 20 is torn along the line of openings 26, the proximal part 30*b* of the release liner 30 is not in a position to be contacted or pulled away from the remaining adhesive closure 24*b*. This is to prevent inadvertent exposure and adhesion of that closure 24*b* to the envelope 10 before its intended second use. The outer edge of part 30*b* of the release liner 30 is recessed at least 1/16 inch and more desirably at least ⅛ inch and most preferably at least 3/16 inch from the line of openings 26.

Figure 4:
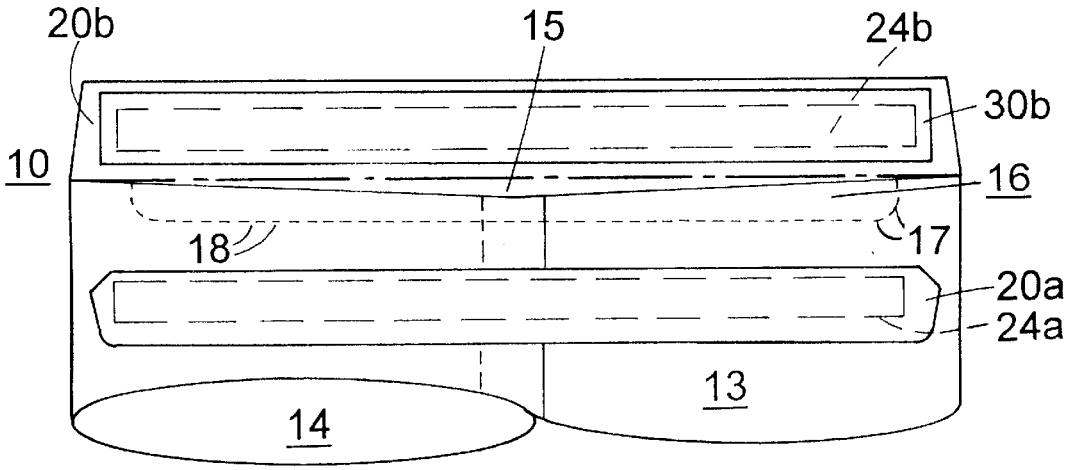
FIG. 4 is a cut-away plan view of the mouth opening end of the package of FIGS. 1–3 after opening of the sealed closure flap.
Figure 5:
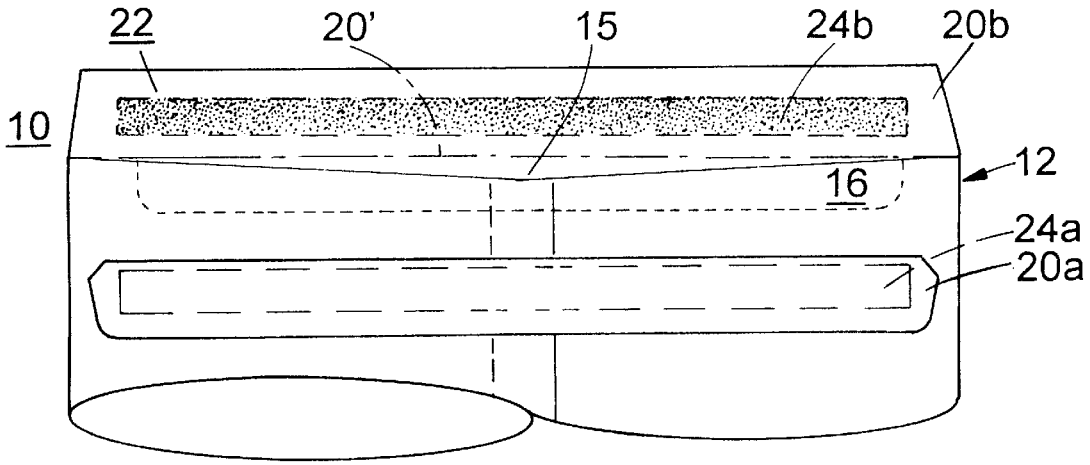
FIG. 5 is a cut-away plan view of the mouth opening end of the package of FIGS. 1–4 after the second half of the release liner is removed from the package.

Referring now to FIG. 4, for the second use, the closure flap 20 is again folded away from the body 12 to expose the mouth opening 15 to receive the contents of the envelope 10. The remaining portion 30*b* of the release liner 30 is removed and the remaining portion 20*b* of the closure flap 20 is again fully extended over the mouth opening 15 and pressed against the body 13 to close and seal the mouth opening 15. The sealed envelope could be open in a conventional fashion a second time by physically separating either the remainder 20*b* of the closure flap 20 or the panel 13 from the adhesive closure 24*b*. However, if a breakaway region 16 is provided, it would be torn from the remainder of panel 14 along line of openings 17.

It will be appreciated by those skilled in the art that changes could be made to the embodiments described above without departing from the broad inventive concept thereof. For example, while it is preferred to use the outermost (distal) adhesive closure 24*a* first, the innermost (proximal) closure 24*b* might be used first, particularly if a breakaway region 16 is provided. While a single release liner 30 with a line of weakness 32 is preferred, separate release liners might be employed. The line of openings 26 through the closure flap should still be located farther from the mouth opening 15 than the outermost (distal) edge of the innermost release liner 30*b*. While the invention has been described incorporated into a flat envelope, the invention is identically adapted for use in expansion or expandable envelopes, which add gussets to the body of the envelope along the side edges of the body extending away from the mouth. The invention can easily be incorporated into other types of envelopes and packaging. It is understood, therefore, that this invention is not limited to the particular embodiments disclosed, but it is intended to cover modifications within the spirit and scope of the present invention as defined by the appended claims.

We claim:

1. A multiple-use, sealable package comprising:

a body of spunbonded olefin sheet, the body having at least one side edge with a mouth opening;

a closure flap of spunbonded olefin sheet extending from the body at the side edge along the mouth opening, the closure flap having an inner surface facing and overlapping an edge portion of the body adjoining the mouth opening with the closure flap folded and fully extended over the mouth opening and against the body to close the mouth opening;

two separate and spaced apart adhesive closures, each adhesive closure being located on the spunbonded olefin sheet proximal the mouth opening, one adhesive closure being located farther from the mouth opening than is a remaining adhesive closure;

a line of openings extending through and across the closure flap, the openings being spaced sufficiently closely to one another along the line that a tear force required to break bridges of the spunbonded olefin sheet of the closure flap between adjoining pairs of the openings of the line is less than a tear force required to separate one of the adhesive closures from the spunbonded olefin sheet supporting the one adhesive closure, the line of openings being located on the closure flap to extend between the two adhesive closures with the closure flap positioned to fully overlap the edge portion of the package body; and release liner means positioned to overlie each of the two adhesive closures for protecting the adhesive closures before use, the release liner means being in two parts, one of the two parts overlying the remaining adhesive closure and having an outermost edge located closer to the mouth opening than is the line of openings extending through and across the closure flap.

2. The multi-use, resealable package according to claim 1 wherein the two adhesive closures are located on the same one of the inner surface of the closure flap and the edge portion of the body and wherein the release liner means is a single release liner positioned overlying each of the two adhesive closures, the release liner being divided by at least one line of weakness extending across the release liner, the release liner line of weakness being located on the package to lie between the two adhesive closures and to be closer to the mouth opening than is the line of openings through the closure flap.

3. The multiple-use, sealable package according to claim 2 further including at least one notch into an edge of the closure flap at one end of the line of openings through the closure flap, the notch defining an opening larger in area than areas of any of the openings in the closure flap adjoining the notch.

4. The multiple-use, sealable package according to claim 2 wherein the release liner and the adhesive closures are located on the inner surface of the closure flap.

5. The multiple-use, sealable package according to claim 2 wherein the adhesive closures comprise hot melt, pressure sensitive adhesive.

6. The multiple-use, sealable package according to claim 2 being a flat envelope.

7. The multiple-use, sealable package according to claim 2 wherein the body has three remaining, permanently closed side edges.

8. The multiple-use, sealable package of claim 1 further comprising a breakaway region in the body defined by a continuous line of openings through the body proximal the mouth opening, at least part of the remaining adhesive closure overlapping at least part of the breakaway region with the closure flap folded and fully extended over the edge portion of the body to close the mouth opening such that the overlapped breakaway region is subject to tear forces applied to separate the closure flap from the body where the closure flap and body are held together with the remaining adhesive closure, the continuous line of openings through the body defining the breakaway region and the openings being spaced sufficiently closely to one another in the body along the line that a tear force required to break bridges of the spunbonded olefin sheet left between adjoining pairs of openings is less than a tear force required to separate at least one of the closure flap and the breakaway region from the remaining adhesive closure.

9. The multiple-use, sealable package according to claim 1 wherein the two adhesive closures are the only means of the package for engaging the closure flap with the body each time the closure flap is secured to the body with one of the two adhesive closures.

10. A multiple-use, sealable flat envelope comprising:

a body of spunbonded olefin sheet having two flat, juxtaposed panels, one side edge with a mouth opening and three remaining, permanently closed side edges;

a spunbonded olefin sheet closure flap extending continuously in one piece from one of the panels of the body along at the one side edge of the body, the closure flap having an inner surface facing and overlapping an edge portion of a remaining panel of the body adjoining the mouth opening when the closure flap is folded back towards the body and fully extended over the mouth opening against the remaining panel of the body to close the mouth opening;

two adjoining but separate and spaced apart hot melt, pressure sensitive adhesive closures on the spunbonded olefin sheet of the inner surface of the closure flap;

a line of openings through the closure flap extending entirely across the closure flap, the openings being spaced sufficiently closely to one another along the line that a tear force required to break bridges of the spunbonded olefin sheet of the closure flap between adjoining pairs of the openings of the line is less than a tear force required to separate either adhesive closure from the spunbonded olefin sheet of the closure flap supporting the adhesive closures and;

a release liner on the inner surface of the closure flap positioned overlying each of the two adhesive closures, the release liner being divided by a line of weakness extending across the release liner, the release liner line of weakness being located on the closure flap to lie between the two adhesive closures and to be closer to the mouth opening than is the line of openings through the closure flap.

* * * * *